US006569590B2

(12) United States Patent
Kuroda et al.

(10) Patent No.: US 6,569,590 B2
(45) Date of Patent: May 27, 2003

(54) MASTER BATCH PIGMENT, TONER INCLUDING THE MASTER BATCH PIGMENT AND METHOD FOR MANUFACTURING THE TONER

(75) Inventors: Noboru Kuroda, Tagata-gun (JP); Shoichi Sugiyama, Gotemba (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/935,600

(22) Filed: Aug. 24, 2001

(65) Prior Publication Data

US 2002/0048712 A1 Apr. 25, 2002

(30) Foreign Application Priority Data

Aug. 24, 2000 (JP) ..... 2000-254314

(51) Int. Cl.[7] ..... G03G 9/087

(52) U.S. Cl. ..... 430/108.6; 430/109.4; 430/137.18

(58) Field of Search ..... 430/137.18, 108.1, 430/109.2, 109.4, 108.7, 108.6

(56) References Cited

U.S. PATENT DOCUMENTS

| | | | | |
|---|---|---|---|---|
| 5,529,871 A | | 6/1996 | Ichimura et al. | |
| 5,547,800 A | * | 8/1996 | Nishimori et al. | 430/110 |
| 6,074,795 A | | 6/2000 | Watanabe et al. | |
| 6,180,298 B1 | | 1/2001 | Kuroda et al. | |
| 6,183,926 B1 | | 2/2001 | Kuroda et al. | |
| 6,200,719 B1 | | 3/2001 | Kuroda | |
| 6,258,502 B1 | | 7/2001 | Nakamura et al. | |
| 6,395,443 B2 | | 5/2002 | Kuroda et al. | |

FOREIGN PATENT DOCUMENTS

| | | |
|---|---|---|
| EP | 0 720 063 | 7/1996 |
| EP | 0 822 460 | 2/1998 |
| JP | 57-130043 | 8/1982 |
| JP | 57-130044 | 8/1982 |
| JP | 62-280755 | 12/1987 |
| JP | 02-066561 | 3/1990 |
| JP | 04-039671 | 2/1992 |
| JP | 04-230770 | 8/1992 |
| JP | 09-101632 | 4/1997 |

OTHER PUBLICATIONS

Derwent Abstract, AN 1994–257408, JP 6–130724, May 13, 1994.

Patent Abstracts of Japan, JP 11–237755, Aug. 31, 1999.

* cited by examiner

*Primary Examiner*—John Goodrow

(74) *Attorney, Agent, or Firm*—Oblon, Spivak, McClelland, Maier & Neustadt, P.C.

(57) ABSTRACT

A method is provided for manufacturing a master batch pigment for a toner, including the steps of mixing a dry pigment powder, a binder resin and water to prepare a mixture thereof; and kneading the mixture upon application of heat to prepare the master batch pigment, wherein the master batch pigment has a weight loss of from 0.01 to 1.0% when heated at 110° C. for 2 hrs.

32 Claims, No Drawings

MASTER BATCH PIGMENT, TONER INCLUDING THE MASTER BATCH PIGMENT AND METHOD FOR MANUFACTURING THE TONER

BACKGROUND OF THE INVENTION

1. Field of the Invention

The present invention relates to a master batch pigment and a toner including the master batch pigment as well as a method for manufacturing the toner.

2. Discussion of the Background

A toner used for a dry developing method is mainly formed from a thermoplastic resin (i.e., a binder resin), a pigment (i.e. a colorant) and a release agent. Optionally, an additive such as a magnetic powder, a charge controlling agent or a fluidity improving agent is added thereto. As disclosed in Japanese Laid-Open Patent Publication No. 1-304467, a typical manufacturing method for such a toner is as follows:

(1) all the constituents for such a toner are mixed together and the mixture is heated (i.e., melted) and dispersed by a kneading machine to a uniform composition; and (2) the composition is cooled, pulverized and classified into toner having a volume average diameter of from about 6 to about 10 $\mu$m.

Particularly, a color toner for electrophotography, which is used to form a colored image, is typically formed from a binder resin, in which various coloring dyes or pigments are dispersed. Requisites for such a color toner are more severe than that for a black toner. Namely, a color toner is required to have color reproducibility and optical transmittance (i.e., transparency) when used for an over head projector (OHP) in addition to mechanical and electrical stability.

Specific examples of dyes for use as a colorant of a toner include those disclosed in Japanese Laid-Open Patent Publications Nos. 57-130043 and 57-130044. When a dye is used as a colorant, the resultant image has good transparency and coloring ability, and it is possible to form a clear color image.

However, a problem which occurs is that the image has poor light resistance and the color of an image is changed or faded when it is left under direct light.

On the other hand, specific examples of pigments for use as a colorant include those disclosed in Japanese Laid-Open Patent Publications Nos. 49-46951 and 52-17023. However, although a pigment type color toner has good light resistance, the toner has poor coloring ability and transparency because the pigment has poor dispersibility in a binder resin.

As a method for improving dispersiblity of a pigment in a binder resin, the following technology is disclosed in Japanese Laid-Open Patent Publication No. 62-280755:

(1) a polyester resin (resin A) is used as a binder resin; (2) a pigment is covered by a polyester resin having a higher molecular weight (resin B) than the resin A; and (3) the covered pigment is dispersed in the resin A to form a color toner.

In addition, the following color toner is disclosed in Japanese Laid-Open Patent Publication No. 2-66561:

a processed pigment obtained by melting and kneading a pigment and a resin for the pigment is dispersed in a binder resin, wherein the average molecular weight of the resin for the pigment is lower than the average molecular weight of the binder resin and the average molecular weight of the binder resin is not less than 100,000.

Another technology to obtain a color toner is also disclosed in Japanese Laid-Open Patent Publication No. 9-101632:

(1) a binder resin and a pigment are mixed with an organic solvent at a lower temperature than the melting point of the binder resin in the first stage; and (2) the binder resin and a charge controlling agent are further added into the mixture prepared in the first stage and kneaded while heating in the second stage.

Further, a toner including a colorant made of a binder resin having an average molecular weight of not greater than 40,000 and a flushed pigment using the binder resin is disclosed in Japanese Laid-Open Patent Publication No. 4-39671.

In addition, the following technology is disclosed in Japanese Laid-Open Patent Publication No. 4-230770:

(1) a solvent, a first binder resin soluble in the solvent and a colorant insoluble in the solvent are mixed;

(2) the colorant is dispersed in the binder resin at from 50 to 100° C. while applying a shearing stress thereto;

(3) the solvent is removed to obtain a colorant/binder resin composition, in which the particles of the colorant are dispersed in the binder resin; and then, (4) the binder resin and a charge controlling agent are further added into the composition, which is kneaded upon application of heat in the second stage to obtain a toner.

However, a toner in which a pigment is well dispersed cannot be prepared by any one of the methods of above-mentioned Japanese Laid-Open Patent Publications Nos. 62-280755 and 2-6651, and coloring stability and transparency of the resultant toners are poor.

In addition, the present inventors recently discovered that in any methods of above-mentioned Japanese Laid-Open Patent Publications Nos. 9-101632, 4-39671 and 4-230770, a small amount of the solvent remains in the resultant toner even if the removal of the solvent is attempted. In addition, the remaining solvent deteriorates chargeability of the resultant toner particularly in a high temperature environment, resulting in a problem wherein the toner scatters at a developing section.

SUMMARY OF THE INVENTION

Accordingly, an object of the present invention is to provide a master batch pigment for a toner capable of producing a toner which does not cause the above-mentioned problems, and which has a good combination of coloring ability, transparency and chargeability.

Another object of the present invention is to provide a toner using the master batch pigment.

Yet another object of the present invention is to provide a method for manufacturing the toner.

Briefly these objects and other objects of the present invention as hereinafter will become more readily apparent can be attained by a method for manufacturing a master batch pigment for a toner, including the steps of mixing a dry pigment powder, a binder and water; and kneading the mixture upon application of heat to prepare the master batch pigment, wherein the master batch pigment has a weight loss of from 0.01 to 1.0% when heated at 110° C. for 2 hrs.

In another aspect of the present invention, a method for manufacturing a color toner is provided, which includes the steps of preparing the master batch pigment mentioned above; kneading a binder resin, which may be the same as or different from the binder resin included in the master batch pigment, with the master batch pigment such that the concentration of the pigment is less than the concentration of the pigment in the master batch pigment; and pulverizing the mixture.

In addition, the above-mentioned objects can be attained by a master batch pigment characterized in that the weight loss is from 0.01 to 1.0% when heated at 110° C. for 2 hrs. and not greater than 0.05% at 70° C. for 2 hrs.

Further, the above-mentioned objects can be attained by a color toner prepared by the method mentioned above. Namely the master batch pigment is further mixed with a binder resin which is the same as or different from the binder resin included in the master batch pigment until the concentration of the pigment in the mixture reaches the target concentration for the toner, and then the mixture is pulverized.

Still, the above-mentioned objects can be attained by a method for manufacturing the above-mentioned color toner.

These and other objects, features and advantages of the present invention will become apparent upon consideration of the following description of the preferred embodiments of the present invention.

DETAILED DESCRIPTION OF THE INVENTION

Generally, the present invention provides a master batch pigment in which a pigment is well dispersed in a binder resin, wherein the weight loss is from 0.01 to 1.0% when heated at 110° C. for 2 hrs. and not greater than 0.05% when heated at a relatively low temperature of 70° C. for 2 hrs.

When such a master batch pigment is used for a toner, the dispersion of the pigment in the resin can be significantly improved.

In addition, the present invention provides a toner using the master batch pigment including a pigment, wherein the toner (i.e., a color toner and a black toner) is manufactured by a conventional kneading process upon application of heat followed by a pulverizing process, and wherein the pigment is used as a colorant.

The master batch pigment of the present invention is characterized in that a dry pigment powder, water and a binder resin are mixed; and the mixture is kneaded upon application of heat to remove the water until the weight loss of the mixture is from 0.01 to 1.0% when heated at 110° C. for 2 hrs. and not greater than 0.05% when heated at 70°C. for 2 hrs.

The primary particle of a pigment itself is very small, having a particle diameter of from 0.001 to 0.1 $\mu$m. However, a dry pigment powder used as a raw material for a toner forms big agglomerated pigments of a few micrometers. It is ideal to pulverize the agglomerated pigment into primary particles, however, it is impossible to pulverize the pigment such that it has a diameter of from 0.001 to 0.1 $\mu$m or smaller by a conventional kneading method in which a mechanical shearing stress is repeatedly applied.

One reason why a pigment is not well dispersed is that the agglomerated pigment cannot be pulverized. Therefore, in order to pulverize the agglomerated pigment, it is essential that a resin around the agglomerated pigment percolates into the agglomerated pigment such that all the primary particles get wet efficiently. Accordingly, the dispersion of a pigment depends upon whether a resin around the agglomerated pigment can percolate into the agglomerated pigment. However, since a binder resin which is used for a conventional toner has a high melting viscosity, a large amount of energy is needed to cause the resin to enter inside the agglomerated pigment. Nevertheless, the pigment does not become the primary particle as desired.

The present invention is characterized in that water is used as a medium for wetting a dry pigment powder. Although an organic pigment which is used as a colorant is typically hydrophobic, it is possible to soak water into an agglomerated pigment if enough energy is added because the manufacturing process of the pigment includes water washing and drying processes.

When an agglomerated pigment in which water is soaked and a resin are kneaded using an open type kneading machine at a temperature not lower than 100° C., the water inside the agglomerated pigment quickly reaches a boiling point and the volume of the water almost explosively expands, resulting in generation of sufficient inside energy to pulverize the agglomerated pigment. The inside energy of the agglomerated pigment can pulverize the agglomerated pigment much more efficiently than an outside energy. In addition, since the resin is heated to a temperature not less than its softening point and therefore has a low viscosity, the resin can efficiently wet the agglomerated pigment, and at the same time water nearly at the boiling point inside the agglomerated pigment is replaced with the resin, which is similar to so-called "flushing". Thus a master batch pigment in which a pigment having a particle diameter close to that of the primary particle is dispersed in a resin is formed.

Further, absorption of water into the agglomerated pigment in a material mixing process prior to the kneading process is an exothermic reaction, i.e., a discharging process of an internal latent heat of the pigment, and thereby the pigment achieves a stable state in energy. In addition, in the process during which water evaporates, since the evaporation latent heat is deprived from the mixture, the temperature of the mixture is kept at a temperature not greater than 100° C. Therefore the mixture has a high viscosity and a shearing stress is effectively applied to the agglomerated pigment.

The reason why water is used in the present invention is that water has a lower affinity with pigments and resins than organic solvents and therefore water can be easily removed in the kneading process in spite of its higher boiling point. Since a conventional organic solvent has a high affinity with a charge controlling agent used in a toner, even quite a small amount of the solvent in the toner causes a problem such as deterioration of the chargeability of the toner, because the solvent in the toner moves, disperses, and/or evaporates in a high temperature environment.

In addition, since it is not preferable that a large amount of water remains in a master batch pigment, it is preferable to remove added water in the kneading process upon application of heat by the above-mentioned open type kneading machine.

Specific examples of the open type kneading machines for use in the present invention include conventional two-roll, three-roll kneading machines, a Bumbury's mixer which is used as an open type kneading machine and a continuous two-roll kneading machine manufactured by Mitsui Mining Co., Ltd.

Specific examples of the black pigments for use in the present invention include azine pigments such as carbon black, oil furnace black, channel black, lamp black, acetylene black and aniline black, metal salts of azo pigments, metal oxides, complex metal oxides, etc.

Specific examples of the yellow pigments for use in the present invention include cadmium yellow, Mineral Fast Yellow, Nickel Titan Yellow, naples yellow, Naphthol Yellow S, Hansa Yellow G, Hansa Yellow 10G, Benzidine Yellow GR, Quinoline Yellow Lake, Permanent Yellow NCG, Tartrazine Lake, etc.

Specific examples of the orange color pigments for use in the present invention include Molybdenum Orange, Permanent Orange GTR, Pyrazolone Orange, Vulcan Orange G, Indanthrene Brilliant Orange GK, etc.

Specific examples of the red pigments for use in the present invention include red iron oxide, cadmium red, Permanent Red 4R, Lithol Red, Pyrazolone Red, Watching Red calcium salts, Lake Red D, Brilliant Carmine 6B, Eosine Lake, Rhodamine Lake B, Alizarine Lake, Brilliant Carmine 3B, etc.

Specific examples of the violet pigments for use in the present invention include Fast Violet B, Methyl Violet Lake, etc.

Specific examples of the blue pigments for use in the present invention include cobalt blue, Alkali Blue, Victoria Blue Lake, Phthalocyanine Blue, metal-free Phthalocyanine Blue, partialy chlorinated Phthalocyanine Blue, Fast Sky Blue, Indanthrene Blue BC, etc.

Specific examples of the green pigments for use in the present invention include a chrome green, chrome oxide, Pigment Green B, Malachite Green Lake, etc.

All the pigments are dry pigment powders. These pigments can be used alone or in combination.

In addition, the master batch pigment of the present invention preferably has a weight loss of from 0.01 to 1.0% when heated at 110° C. for 2 hrs. and not greater than 0.05% when heated at 70° C. for 2 hrs. If the weight loss of the pigment is not less than 1.0% when heated at 110° C., water included in the pigment adversely affects not only the quality of the resultant toner but also the pigment dispersion in the master batch pigment due to insufficient shearing stress. To the contrary, in order to prepare a master batch pigment having a weight loss not greater than 0.01% when heated at 110° C. for 2 hrs, an excess shearing stress and a heat have to be applied to the mixture in the kneading process. Therefore, a part of the binder resin is cut, resulting in occurrence of a problem such as increase of low molecular weight components. In addition, a master batch pigment weight loss of not less than 0.05% when heated at 70° C. for 2 hrs. is not preferable because the chargeability of the resultant toner deteriorates in a high temperature environment.

In the present invention, the weight loss is measured as follows:

(1) a sample of a master batch pigment to be measured is sieved with a screen having openings of 0.15 mm and a screen having openings of 2.0 mm;

(2) the particles present between the screens are weighed and stored for 2 hrs. at a specified temperature (i.e. 110° C. or 70° C.)

(3) and after the sample is cooled in a desiccator for 0.5 hrs., the sample is weighed to determine the weight loss.

Known resins can be used as a binder resin of the master batch pigment and a dilution binder resin to be added to the master batch pigment. For instance, vinyl resins, polyester resins or polyol resins can be used, and polyester resins or a polyol resins can be preferably used.

Specific examples of the vinyl resins include polymers of styrene and its substitutes such as polystyrene, poly-p-chlorostyrene and polyvinyltoluene, styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl methacrylate copolymers, styrene-butyl methacrylate copolymers, styrene-α-methyl chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleate copolymers and styrene-ester maleate copolymers, polymethyl methacrylate, polyvinyl chloride, polyvinyl acetate, etc.

Specific examples of the polyester resins include the polyester resins constituted of one or more of the following dihydric alcohols in group A and one or more of the dibasic acids in group B and optionally one or more of the following alcohols having not less than 3 hydroxyl groups or carboxylic acids of Group C.

Group A: ethylene glycol, triethylene glycol, 1,2-propylene glycol, 1,3-propylene glycol, 1,4-butane diol, neopentyl glycol, 1,4-butene diol, 1,4-bis(hydroxymethyl) cyclohexane, bisphenol A, hydrogenated bisphenol A, polyoxyethylenated bisphenol A, polyoxypropylene-(2,2)-2,2'-bis(4-hydroxyphenyl)propane, polyoxypropylene-(3,3)-2,2-bis(4-hydroxyphenyl)propane, polyoxyethylene-(2,0)-2,2-bis(4-hydroxyphenyl)propane, polyoxypropylene-(2,0)-2,2'-bis(4-hydroxyphenyl)propane, etc.

Group B: maleic acid, fumaric acid, mesaconic acid, citraconic acid, itaconic acid, glutaconic acid, phthalic acid, isophthalic acid, terephthalic acid, cyclohexane dicarboxylic acid, succinic acid, adipic acid, sebacic acid, malonic acid, a linolenic acid or their anhydrides, or esters thereof with lower alcohols, etc.

Group C: alcohols having not less than 3 hydroxyl groups such as glycerin, trimethylolpropane and pentaerythritol, and carboxylic acids having not less than 3 carboxyl groups such as trimellitic acid and pyromellitic acid.

Specific examples of the polyol resins include reaction products of the following components:

① an epoxy resin;

② an adduct of a dihydric phenol compound with an alkylene oxide or its glycidyl ether compound;

③ a compound having one active hydrogen atom reactive with the epoxy resin; and

④ a compound having two or more active hydrogen atoms reactive with the epoxy resin.

One or more other resins can be added to the above-mentioned resins. Specific examples thereof include the following resins:

epoxy resins, polyamide resins, urethane resins, phenol resins, butyral resins, rosins, denatured rosins, terpene resins, etc.

Specific examples of the epoxy resins include polycondensation products of a bisphenol compound such as bisphenol A and bisphenol F with epichlorohydrin.

When the master batch pigment of the present invention is used for a toner, a charge controlling agent is preferably included in the toner as an internal additive to the toner or added to the toner as an external additive to control the charge of the toner so as to be suitable for the developing system.

Specific examples of the charge controlling agents for use in the present invention include Nigrosin; azine dyes including an alkyl group having 2 to 16 carbon atoms disclosed in Japanese Patent Publication No. 42-1627; basic dyes (e.g. C.I. Basic Yellow 2 (C.I. 41000), C.I. Basic Yellow 3,C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510) C.I. Basic Blue 1 (C.I. 42025), C.I. Basic Blue 3 (C.I. 51005) C.I. Basic Blue 5 (C.I. 42140), C.I. Basic Blue 7 (C.I. 42595) C.I. Basic Blue 9 (C.I. 52015), C.I. Basic blue 24 (C.I. 52030), C.I. Basic Blue 25 (C.I. 52025), Basic Blue 26

(C.I. 44045) C.I. Basic Green 1 (C.I. 42040) and C.I. Basic Green 4 (C.I. 42000)); lake pigments of these basic dyes; C.I. Solvent Black 8 (C.I. 26150); quaternary ammonium salts such as benzoylhexadecylammonium chlorides and decyltrimethyl chlorides; dialkyl tin compounds such as dibuthyl or dioctyl tin compounds; dialkyl tin borate compounds; guanidine derivatives; vinyl polymers including amino groups, polyamine resins such as condensation polymers including an amino group, metal complexes of mono azo dyes disclosed in Japanese Patent Publications Nos. 41-20153, 43-27596, 44-6397 and 45-26478; metal complexes of dicarboxylic acid such as Zn, Al, Co, Cr, and Fe complexes of salicylic acid, dialkylsalicyic acid and naphtoic acid; sulfonated copper phthalocyanine pigments, etc.

In addition, a release agent can be included as an internal additive in the toner in the present invention in order to prevent an offset problem when the toner is fixed on a receiving material. Specific example of the release agents include natural waxes such as candelilla waxes, carnauba waxes and rice waxes, montan waxes, paraffin waxes, sasol waxes, low molecular weight polyethylene, low molecular weight polypropylene, alkylphosphates, etc. These are selected depending on the binder resin of the master batch pigment and the surface material of the fixing roller of the image forming apparatus. The melting point of the release agents is preferably from 65 to 90° C. When the melting point is lower than 65° C., a blocking problem is likely to occur when the toner is stored. When it is higher than 90° C., an offset problem is likely to occur when the temperature of the fixing roller is low.

In addition, in order to improve the fluidity, developing ability and transferability of the toner, an inorganic fine powder can be included in the toner as an external additive.

Specific examples of the inorganic fine powders include oxides and composite oxides of Si, Ti, Al, Mg, Ca, Sr, Ba, In, Ga, Ni, Mn, W, fe, Co, Zn, Cr, Mo, Cu, Ag, V, Zr, etc. Among these inorganic fine powders, silicon dioxide (i.e. silica), titaniumdioxide (i.e. titania) and alumina are preferably used. In addition, a surface treatment of the inorganic powders with a hydrophobizing agent, etc. is effective. The inorganic fine powders are preferably included in the toner in an amount of from 0.1 to 2% by weight of the toner. When the weight is less than 0.1%, it is difficult to improve the toner agglomeration and when it is greater than 2%, problems such as scattering of the toner, inner contamination of the image forming apparatus and damage and/or abrasion of the photoreceptor occur.

The toner of the present invention can be used as both a one-component developer and a two-component developer. When the toner is used as a two-component developer, a carrier powder is mixed with the toner. Known carriers, for instance, magnetic particles such as iron powders, ferrite powders, nickel powders and magnetite powders can be used. These magnetic particles may be coated with fluorocarbon resins, vinyl resins, silicon resins, etc. In addition, resin particles in which magnetic particles are dispersed can also be used as a carrier. The average particle diameter of these magnetic carriers is preferably from 35 to 75 $\mu$m.

The toner of the present invention can be used as a magnetic toner by including a magnetic material. In order to make a magnetic toner, fine particles of a magnetic material are included in the toner particles.

Specific examples of the magnetic materials include ferromagnetic metals such as iron, nickel and cobalt and their metal alloys; compounds including a ferromagnetic metal such as ferrite and magnetite, metal alloys which do not include a ferromagnetic element but becomes ferromagnetic when properly heated such as metal alloys called as "Heusler alloys" including manganese and copper, e.g. manganese copper aluminium and manganese-copper-tin; chrome dioxides, etc. It is preferable that the magnetic materials are evenly dispersed and included in the toner in a form of fine particles having an average particle diameter of from 0.1 to 1 $\mu$m. The content of the magnetic material is preferably from 10 to 70 parts by weight and more preferably from 20 to 50 parts by weight per 100 parts by weight of the toner.

The method for manufacturing the toner of the present invention is, for example, as follows:

(1) the above-mentioned dry pigment powder, water and a binder resin are well mixed by a mixer such as Henschel mixers;
(2) the resultant mixture is kneaded upon application of heat by a two-roll mill, a three-roll mill, a Bumbury's mixer which is used as an open type kneading machine or a continuous two-roll kneading machine manufactured by Mitsui Mining Co., Ltd., to prepare a master batch pigment;
(3) the master batch pigment, a binder resin, a charge controlling agent, a magnetic material, other additives, etc. are well mixed by a mixer such as Henschel mixers;
(4) the resultant mixture is well kneaded upon application of heat by a heat kneading machine such as a batch type two-roll kneading machine, a Bumbury's mixer, a continuous biaxial extrusion machine such as KTK biaxial extrusion machines from Kobe Steel, Ltd., TEM biaxial extrusion machines from Toshiba Machine Co., Ltd., TEX biaxial extrusion machines from Japan Steel Works, Ltd., PCM biaxial extrusion machines from Ikegai Corporation and KEX biaxial extrusion machines from Kurimoto, Ltd. and a continuous one-axis kneading machine such as KO-KNEADER from Buss AG and then cooled;
(5) the thus kneaded mixture is crushed by a hammer mill, etc. and pulverized by a pulverizer such as jet stream pulverizers and mechanical pulverizers;
(6) the pulverized mixture is classified by a classifying apparatus such as apparatuses using rotary stream and Coanda effect to prepare a mother toner having a desired diameter; and then
(7) the mother toner and an inorganic fine powder are well mixed with a mixer such as Henschel mixers and sieved through a screen having not less than 250 mesh to remove large and agglomerated particles, resulting in formation of the toner of the present invention.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following materials were mixed with a Henschel mixer to prepare a mixture in which the agglomerated pigment was soaked with water.

| | |
|---|---|
| Pigment: Quinacridone magenta pigment (C.I. Pigment Red 122) | 50 |
| Binder resin: Polyol resin | 50 |
| Water | 30 |

The mixture was kneaded upon application of heat with a two-roll kneading machine for 45 minutes to prepare a master batch pigment (1), wherein the surface temperature of the rolls was set at 130° C. The weight loss of the master batch pigment (1) was 0.02% at 110° C. and 0.00% at 70° C.

Next, the following materials were mixed with a Henschel mixer:

| | |
|---|---|
| Binder resin: Polyol resin | 100 |
| Colorant: Master batch pigment (1) | 13 |
| Charge controlling agent: Zinc salycilate salt | 2 |

(1) The mixture was kneaded upon application of heat with a biaxial extrusion machine;
(2) the resultant mixture was cooled by rolling and crushed with a hammer mill;
(3) the mixture was further pulverized and classified with a classifying apparatus to prepare pulverized particles;
(4) one part of hydrophobic silica was added into the resultant particle and mixed with a Henschel mixer; and then,
(5) the agglomerated pigment was removed with an ultrasonic vibrating screen to prepare a toner of Example 1.

5 parts of the toner were mixed with 95 parts of a carrier coated with a silicone resin to prepare a two-component developer.

Evaluation of Master Batch Pigment (1) dispersion status was evaluated with a transmission electron microscope.

Evaluation of Toner (1) coloring ability
(2) transparency (i.e. haze factor)
(3) chargeability at temperatures of 20° C. and 40° C.
(4) contamination of developing section The results of the evaluation are shown in Table 1.

The evaluation method was as follows:

Evaluation of the Pigment Dispersion Status

The master batch pigment was dissolved into tetrahydrofuran at a concentration of 10%. A proper quantity of the liquid was dripped on a preparation and the liquid was covered by a cover glass. The liquid was observed with a transmission electron microscope to evaluate the dispersion status of the pigment.

Evaluation standard ⊚: No agglomerated pigment was found.

○: A few agglomerated pigments were found, but the toner qualities are still acceptable.

Δ: Agglomerated pigments were found and problems for the toner qualities occurred.

X: Many agglomerated pigments were found.

Evaluation of Coloring Ability

A fixed toner image was formed on a white paper using the toner, wherein the weight of the image was 1.0 mg/cm$^2$ and the fixing temperature was 160° C. The density of the image was measured by a Macbeth densitometer RD-514. The greater the value, the better the coloring ability.

Evaluation of Transparency (Haze Factor)

A fixed toner image was formed on an OHP sheet using the toner, wherein the weight of the image was 1.0 mg/cm$^2$ and the fixing temperature was 150° C. The haze factor of the image was measured by a direct haze computer HGM-2DP manufactured by Suga Test Instruments Co., Ltd. The smaller the value, the better the transparency.

Evaluation of Chargeability

The toner and a carrier were mixed for 10 minutes in a predetermined environment at a toner concentration of 5% after they were stored for 1 hour at a predetermined temperature. The resultant developer was set in a measurement gauge in which a net having 500 mesh is set and subjected to a blow-off treatment for 30 seconds. The charge amount Q ($\mu$C) and weight M (g) of the toner were measured. The chargeability of the toner was defined as Q/M ($\mu$C/g).

Evaluation of Contamination of Developing Section

The above-mentioned two-component developer prepared in Example 1 was set in a copier Ricoh Imagio color 2800 to perform a running test. The status of toner scattering around the developing section was evaluated after 10,000 copies were printed.

Example 2

The same materials of Example 1 were mixed with a Henschel mixer to prepare a mixture in which the agglomerated pigment was soaked with water. The mixture was kneaded upon application of heat with a two-roll kneading machine for 30 minutes to prepare a master batch pigment (2), wherein the surface temperature of the rolls was set at 110° C.

The weight loss of the master batch pigment (2) was 1.00% at 110° C. and 0.02% at 70° C.

Next, a toner of Example 2 was prepared using the following materials and the same method as that of Example 1.

| | |
|---|---|
| Binder resin: Polyol resin | 100 |
| Colorant: Master batch pigment (2) | 13 |
| Charge controlling agent: Zinc salicylate salt | 2 |

The same evaluation of Example 1 was also made on Example 2.

The results of the evaluation are shown in Table 1-(2), 1-(3) and 1-(4).

Example 3

The procedure for preparation and evaluation of the master batch pigment and the toner of Example 1 was repeated to prepare a master batch pigment (3) and a toner of Example 3 except that the binder resin was changed to a polyester resin and the colorant for formation of the toner was changed to master batch pigment (3).

The weight loss of master batch pigment (3) was 0.02% at 110° C. and 0.00% at 70° C.

The results of the evaluation are shown in Table 1-(2) 1-(3) and 1-(4).

Example 4

The following materials were processed in the same method as that of Example 1 to prepare a master batch pigment (4).

| | |
|---|---|
| Pigment: Copper phthalocyanine blue pigment (C.I. Pigment Blue 15) | 50 |
| Binder resin: Polyester resin | 50 |
| Water | 25 |

The weight loss of the master batch pigment (4) was 0.01% at 110° C. and 0.00% at 70° C.

Next, a toner of Example 4 was prepared using the following materials and the same method as that of Example 1.

| | |
|---|---|
| Binder resin: Polyester resin | 100 |
| Colorant: Master batch pigment (4) | 6 |
| Charge controlling agent: Zinc salicylate salt | 2 |

The same evaluation of Example 1 was also made on Example 4.

The results of the evaluation are shown in Table 1-(2) 1-(3) and 1-(4).

Comparative Example 1

The same materials of Example 1 were mixed with a Henschel mixer to prepare a mixture in which the agglomerated pigment was soaked with water. The mixture was kneaded upon application of heat with a two-roll kneading machine for 90 minutes to prepare a master batch pigment (5), wherein the surface temperature of the rolls was set at 130° C. The weight loss of the master batch pigment (5) was 0.005% at 110° C. and 0.000% at 70° C.

Next, a toner of Comparative example 1 was prepared using the master batch pigment (5) in the same method as that of Example 1. The same evaluation of Example 1 was also made on Comparative example 1.

The results of the evaluation are shown in Table 1-(2) 1-(3) and 1-(4).

This method not only reduced the productivity of the toner but also caused a filming problem in the running test (i.e., a toner film was formed on the photoreceptor) and, therefore it was practically impossible to print more than 10,000 copies by the toner.

Comparative Example 2

The same materials of Example 1 were mixed with a Henschel mixer to prepare a mixture in which the agglomerated pigment was soaked with water. The mixture was kneaded upon application of heat with a two-roll kneading machine for 15 minutes to prepare a master batch pigment (6), wherein the surface temperature of the rolls was set at 110° C. The weight loss of the master batch pigment (6) was 2.00% at 110° C. and 0.03% at 70° C.

Next, a toner of Comparative example 2 was prepared using the master batch pigment (6) in the same method as that of Example 1. The same evaluation of Example 1 was also made on Comparative example 2.

The results of the evaluation are shown in Table 1-(2) 1-(3) and 1-(4).

Comparative Example 3

The following materials were mixed with a Henschel mixer to prepare a mixture.

| | |
|---|---|
| Pigment: Quinacridone magenta pigment (C.I. Pigment Red 122) | 50 |
| Binder resin: Polyol resin | 50 |

The mixture was kneaded upon application of heat with a two-roll kneading machine for 45 minutes to prepare a master batch pigment (7), wherein the surface temperature of the rolls was set at 130° C. The weight loss of the master batch pigment (7) was 0.00% at 110° C. and 0.00% at 70° C.

Next, a toner of Comparative example 3 was prepared using the master batch pigment (7) in the same method as that of Example 1. The same evaluation of Example 1 was also made on Comparative example 3.

The results of the evaluation are shown in Table 1-(2) 1-(3) and 1-(4).

Comparative Example 4

The following materials were mixed with a Henschel mixer to prepare a mixture in which the agglomerated pigment was soaked with water and acetone.

| | |
|---|---|
| Pigment: Quinacridone magenta pigment (C.I. Pigment Red 122) | 50 |
| Binder resin: Polyol resin | 50 |
| Water 50% and acetone 50% | 30 |

The mixture was kneaded upon application of heat with a two-roll kneading machine for 45 minutes to prepare a master batch pigment (8), wherein the surface temperature of the rolls was set at 130° C. The weight loss of the master batch pigment (8) was 2.00% at 110° C. and 0.60% at 70° C.

Next, a toner of Comparative example 4 was prepared using the master batch pigment (8) in the same method as that of Example 1. The same evaluation of Example 1 was also made on Comparative example 4.

The results of the evaluation are shown in Table 1-(2), 1-(3) and 1-(4).

TABLE 1

| | Pigment | Resin | Auxiliary agent in kneading master batch pigment |
|---|---|---|---|
| Example 1 | Quinacridone Magenta pigment (C.I. Pigment Red 122) | Polyol resin | Water (30%) |
| Example 2 | | | |
| Example 3 | | | |
| Example 4 | Copper phthalocyanine blue pigment (C.I. Pigment Blue 15) | Polyester resin | Water (25%) |
| Comparative Example 1 | Quinacridone Magenta pigment (C.I. Pigment Red 122) | Polyol resin | Water (30%) |
| Comparative Example 2 | | | |
| Comparative Example 3 | | | None |
| Comparative Example 4 | | | Water and acetone (30%) |

TABLE 1-(2)

| | Properties of master batch pigment | | |
|---|---|---|---|
| | Weight Loss | | Pigment dispersion |
| | 110° C. | 70° C. | Status |
| Example 1 | 0.02 | 0.00 | ◎ |
| Example 2 | 1.00 | 0.02 | ○ |
| Example 3 | 0.02 | 0.00 | ◎ |
| Example 4 | 0.01 | 0.00 | ◎ |

TABLE 1-(2)-continued

| | Properties of master batch pigment | | |
|---|---|---|---|
| | Weight Loss | | Pigment dispersion |
| | 110° C. | 70° C. | Status |
| Comparative Example 1 | 0.005 | 0.00 | ⊙ |
| Comparative Example 2 | 2.00 | 0.03 | Δ |
| Comparative Example 3 | 0.00 | 0.00 | X |
| Comparative Example 4 | 2.00 | 0.60 | ⊙ |

TABLE 1-(3)

| | Properties of toner | | | |
|---|---|---|---|---|
| | Coloring ability | Transparency (haze factor) (%) | Chargeability (μC/g) | |
| | | | 20° C. | 40° C. |
| Example 1 | 2.1 | 14 | −27.3 | −25.5 |
| Example 2 | 1.9 | 20 | −25.1 | −23.3 |
| Example 3 | 2.2 | 12 | −27.1 | −25.2 |
| Example 4 | 2.3 | 10 | −27.6 | −25.8 |
| Comparative Example 1 | 2.2 | 12 | −26.8 | −24.4 |
| Comparative Example 2 | 1.7 | 26 | −20.1 | −18.3 |
| Comparative Example 3 | 1.6 | 46 | −18.8 | −18.5 |
| Comparative Example 4 | 2.1 | 12 | −27.4 | −15.2 |

TABLE 1-(4)

| | Properties of toner 40° C. environment toner scattering (40° C.) |
|---|---|
| Example 1 | None |
| Example 2 | None |
| Example 3 | None |
| Example 4 | None |
| Comparative Example 1 | None |
| Comparative Example 2 | Slightly scattered |
| Comparative Example 3 | None |
| Comparative Example 4 | Seriously scattered |

This document claims priority and contains subject matter related to Japanese Patent Application No. 2000-254314 filed on Aug. 24, 2000 incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for manufacturing a master batch pigment for a toner, comprising:

mixing a dry pigment powder, a binder resin and water to prepare a mixture thereof; and kneading the mixture upon application of heat with an open type kneader to prepare the master batch pigment, wherein the master batch pigment has a weight loss of from 0.01 to 1.0% when heated at 110° C. for 2 hours.

2. The method of claim 1, wherein the master batch pigment has a weight loss not greater than 0.05% when heated at 70° C. for 2 hours.

3. The method of claim 1, wherein the binder resin comprises at least one member selected from the group consisting of polyester resins and polyol resins.

4. The method of claim 3, wherein the polyol resin is a reaction product by reacting an epoxy resin; an adduct of a dihydric phenol compound with an alkylene oxide; a glycidyl ether compound of the alkylene oxide; a compound having an active hydrogen atom reactive with the epoxy resin; and a compound having two or more hydrogen atoms reactive with the epoxy resin.

5. A method for manufacturing a color toner, comprising:

mixing a dry pigment powder, a first binder resin and water to prepare a mixture thereof;

kneading the mixture upon application of heat with an open type kneader to prepare a batch pigment having a pigment concentration C1, wherein the master batch pigment has a weight loss of from 0.01 to 1.0% when heated at 110° C. for 2 hours;

kneading a second binder resin, which is the same or different from the first binder resin with the master batch pigment upon application of heat such that a concentration of the dry pigment powder is less than the concentration C1; and pulverizing the mixture.

6. The method of claim 5, wherein the master batch pigment has a weight loss not greater than 0.05% when heated at 70° C. for 2 hours.

7. The method of claim 5, wherein the binder resin comprises at least one of a polyester resin and a polyol resin.

8. The method of claim 7, wherein the polyol resin is a reaction product by-reacting an epoxy resin; an adduct of a dihydric phenol compound with an alkylene oxide; a glycidyl ether compound of the alkylene oxide; a compound having an active hydrogen atom reactive with the epoxy resin; and a compound having two or more hydrogen atoms reactive with the epoxy resin.

9. A master batch pigment for a toner, wherein the master batch pigment is prepared by mixing a dry pigment powder, a binder resin and water and kneading the mixture upon application of heat with an open type kneader, and wherein the master batch pigment has a weight loss of from 0.01 to 1.0% when heated at 110° C. for 2 hours and not greater than 0.05% at 70° C. for 2 hours.

10. The master batch pigment of claim 9, wherein the binder resin comprises at least one member selected from the group consisting of polyester resins and polyol resins.

11. The master batch pigment of claim 10, wherein the polyol resin is a reaction product by reacting an epoxy resin; an adduct of a dihydric phenol compound with an alkylene oxide; a glycidyl ether compound of the alkylene oxide; a compound having an active hydrogen atom reactive with the epoxy resin; and a compound having two or more hydrogen atoms reactive with the epoxy resin.

12. A toner which is prepared by mixing a pigment, a first binder resin and water to prepare a mixture thereof; kneading the mixture upon application of heat with an open type kneader to prepare a master batch pigment having a pigment concentration C1, wherein the master batch pigment has a weight loss of from 0.01 to 1.0% when heated at 110° C. for 2 hours; kneading a second binder resin, which is the same as or different from the first binder resin with the master batch pigment upon application of heat to prepare a second mixture having a pigment concentration lower than the pigment concentration C1; and pulverizing the second mixture.

13. The toner of claim 12, wherein the master batch pigment has a weight loss not greater than 0.05% when heated at 70° C. for 2 hours.

14. The toner of claim 12, wherein the binder resin comprises at least one member selected from the group consisting of polyester resins and polyol resins.

15. The toner of claim 14, wherein the polyol resin is a reaction product by reacting an epoxy resin; an adduct of a dihydric phenol compound with an alkylene oxide; a glycidyl ether compound of the alkylene oxide; a compound having an active hydrogen atom reactive with the epoxy resin; and a compound having two or more hydrogen atoms reactive with the epoxy resin.

16. The toner of claim 12, wherein the toner is prepared by mixing a pigment selected from the group consisting of silica, titanium dioxide and alumina with the pulverized second mixture.

17. A two-component developer comprising a toner and a carrier, wherein the toner is prepared by mixing a pigment, a first binder resin and water to prepare a mixture thereof; kneading the mixture upon application of heat with an open type kneader to prepare a master batch pigment having a pigment concentration C1, wherein the master batch pigment has a weight loss of from 0.01 to 1.0% when heated at 110° C. for 2 hours; kneading a second binder resin, which is the same as or different from the first binder resin with the master batch pigment upon application of heat to prepare a second mixture having a pigment concentration lower than the pigment concentration C1; and pulverizing the second mixture.

18. The two-component developer of claim 17, wherein the master batch pigment has a weight loss not greater than 0.05% when heated at 70° C. for 2 hours.

19. The two-component developer of claim 17, wherein the binder resin comprises at least one member selected from the group consisting of polyester resins and polyol resins.

20. The two-component developer of claim 17, wherein the polyol resin is a reaction product by reacting an epoxy resin; an adduct of a dihydric phenol compound with an alkylene oxide; a glycidyl ether compound of the alkylene oxide; a compound having an active hydrogen atom reactive with the epoxy resin; and a compound having two or more hydrogen atoms reactive with the epoxy resin.

21. The two-component developer of claim 17, wherein the carrier powder comprises at least one member selected from the group consisting of iron powders, ferrite powders, nickel powders and magnetite powders.

22. The two-component developer of claim 17, wherein the average particle diameter of the carrier is from 35 to 75 μm.

23. A one-component developer which is prepared by mixing a magnetic material, a first binder resin and water to prepare a mixture thereof; kneading the mixture upon application of heat with an open type kneader to prepare a master batch pigment having a pigment concentration C1, wherein the master batch pigment has a weight loss of from 0.01 to 1.0% when heated at 110° C. for 2 hours; kneading a second binder resin, which is the same as or different from the first binder resin with the master batch pigment upon application of heat to prepare a second mixture having a pigment concentration lower than the pigment concentration C1; and pulverizing the second mixture.

24. The one-component developer of claim 23, wherein the magnetic material comprises at least one member selected from the group consisting of iron, nickel, cobalt and metal alloys thereof; a compound comprising at least a ferrite and magnetite; a manganese copper aluminium and a manganese-copper-tin; and a chrome dioxide.

25. The one-component developer of claim 23, wherein the average particle diameter of the magnetic material in the one-component developer is from 0.1 to 1 μm.

26. The one-component developer of claim 23, wherein a content of the magnetic material is from 10 to 70 parts by weight per 100 parts by weight of the one-component developer.

27. The method according to claim 1, wherein said open type kneader is selected from the group consisting of a two-roll kneading machine, a three-roll kneading machine, a Bumbury's mixer and a continuous two-roll kneading machine.

28. The method according to claim 5, wherein said open type kneader is selected from the group consisting of a two-roll kneading machine, a three-roll kneading machine, a Bumbury's mixer and a continuous two-roll kneading machine.

29. The master batch pigment according to claim 9, wherein said open type kneader is selected from the group consisting of a two-roll kneading machine, a three-roll kneading machine, a Bumbury's mixer and a continuous two-roll kneading machine.

30. The toner according to claim 12, wherein said open type kneader is selected from the group consisting of a two-roll kneading machine, a three-roll kneading machine, a Bumbury's mixer and a continuous two-roll kneading machine.

31. The two-component developer according to claim 17, wherein said open type kneader is selected from the group consisting of a two-roll kneading machine, a three-roll kneading machine, a Bumbury's mixer and a continuous two-roll kneading machine.

32. The one-component developer according to claim 23, wherein said open type kneader is selected from the group consisting of a two-roll kneading machine, a three-roll kneading machine, a Bumbury's mixer and a continuous two-roll kneading machine.

* * * * *